United States Patent [19]

Gandillon

[11] Patent Number: 4,619,093

[45] Date of Patent: Oct. 28, 1986

[54] DECORATIVE MATERIAL FOR WALLS OF BUILDINGS

[76] Inventor: Jean-Paul Gandillon, 26 rue de Montbrillant, CH 1201 Geneva, Switzerland

[21] Appl. No.: 480,838

[22] Filed: Mar. 31, 1983

[30] Foreign Application Priority Data

Apr. 2, 1982 [CH] Switzerland ..... 2057/82

[51] Int. Cl.[4] ..... B44F 7/00

[52] U.S. Cl. ..... 52/311; 52/204; 52/316; 52/391; 52/432; 52/511; 52/513

[58] Field of Search ..... 52/311, 316, 211, 391, 52/431, 432, 510, 511, 513, 235, 36, 204

[56] References Cited

U.S. PATENT DOCUMENTS

| | | | |
|---|---|---|---|
| 641,525 | 1/1900 | Lewis | 52/36 X |
| 897,353 | 9/1908 | Culley | 52/513 |
| 1,276,894 | 8/1918 | Flanders | 52/511 |
| 1,635,893 | 7/1927 | Lynch | 52/311 X |
| 1,642,842 | 9/1927 | Davis | 52/316 X |
| 2,073,795 | 3/1937 | Haugaard | 52/513 X |
| 2,120,195 | 6/1938 | Valenti | 52/513 |
| 3,264,793 | 8/1966 | Schlensker | 52/511 |
| 3,350,830 | 11/1967 | Smith, Jr. et al. | 52/513 X |
| 3,778,945 | 12/1973 | Medow | 52/316 X |
| 3,982,372 | 9/1976 | Haeussler | 52/235 X |
| 4,020,610 | 5/1977 | Alexander | 52/511 |
| 4,060,951 | 12/1977 | Gere | 52/513 |

FOREIGN PATENT DOCUMENTS

| | | | |
|---|---|---|---|
| 1900689 | 7/1970 | Fed. Rep. of Germany | 52/235 |
| 2036329 | 1/1972 | Fed. Rep. of Germany | 52/235 |
| 2167112 | 7/1973 | France | 52/235 |

*Primary Examiner*—Alfred C. Perham
*Assistant Examiner*—Jean M. Lakemper

[57] ABSTRACT

A combination of decorative elements or blocks of various shape and of fastening elements for applying adaptably for the elements against a wall for decorating it by relief elements.

3 Claims, 5 Drawing Figures

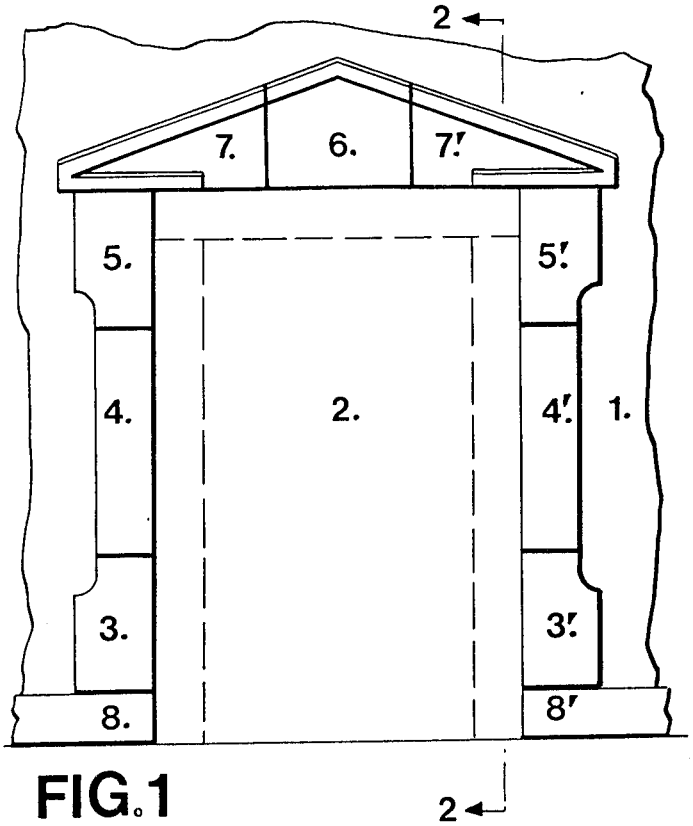
FIG. 1
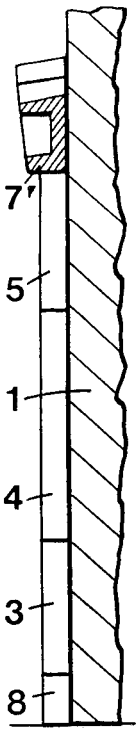
FIG. 2
FIG. 3
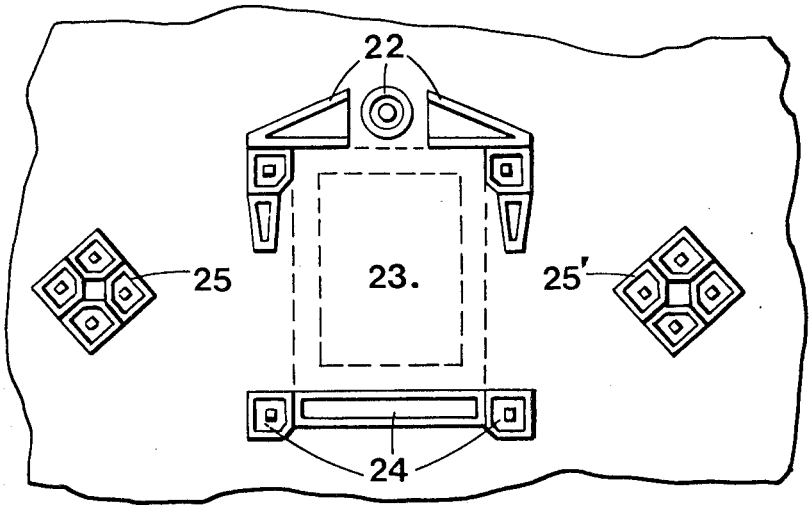

DECORATIVE MATERIAL FOR WALLS OF BUILDINGS

SUMMARY OF THE INVENTION

When assembled, the decorative elements (3, 4, 5, 3', 4', 5', 6, 7, 7', 9) form a frame, in relief, of a door (2). Each element is provided with an engaging device (10, 10') which is interlocked with means of support (13) fixed to a wall in order to hold the element as a "bracket" against the wall. The supporting devices (13) comprise a device (14) embedded in the wall, with an internal thread enabling it to receive a bolt which passes through an oblong hole (16) in a plate (17), thereby allowing the plate to be positioned at the correct height and then immobilized. The plate (17) has a gutter-shaped part (18) which receives the engaging device (10'). Adhesive mortar (19) is inserted between the decorative elements (9) and the wall (1).

Embellishment of the facades of buildings with reliefs is possible at low cost, thanks to the mass production of these decorative elements which may be rapidly mounted as "brackets" on the facade.

BACKGROUND OF THE INVENTION

In former times, buildings commonly featured ornamental cut stone door and window frames, in relief on the facade, as well as cornices, consoles, banisters, balconies and other decorative structures in cut stone. Virtually all of these decorative elements have been eliminated from the architecture of recent decades; moreover, the present-day cost of producing such articles by the traditional method would be prohibitive.

It has been suggested (U.S. Pat. No. 3,778,945) that the entrance to a house be decorated by mounting on the facade blocks of moulded fibre glass consisting of two base pieces flanking the doorway and two pilasters with capitals, surmounted by a pediment. However, according to this former solution, this entire decoration rests on the ground, and simple braces hold the constituent elements against the wall without, however, supporting their weight.

Yet another solution proposes the prefabricated panels supported by stay rods be placed in front of the facade of a building, leaving an insulating space between panels and facade. This entails constructing a "sandwich" wall; the stay rods are attached to the facade, descend diagonally inside the hollow space of the "sandwich", and are attached to the bottom of the panels. Obviously, such a solution could not achieve the aim of the present invention, which provides a new solution whereby the facades (or even internal walls) of buildings may be decorated in relief, using reasonably priced means which nevertheless confer the aesthetically satisfying appearance of "old" buildings.

FIELD OF THE INVENTION

The object of the present invention is material for decorative reliefs on walls of buildings, in accordance with claim 1.

BRIEF DESCRIPTION OF THE DRAWINGS

The attached drawings illustrate examples of embodiments of the material according to the invention.

FIG. 1 is a front view of a first embodiment.

FIG. 2 is a sectional view of 2—2 in FIG. 1.

FIG. 3 is a front view of a second embodiment.

DESCRIPTION OF THE PREFERRED EMBODIMENTS

FIGS. 1 and 2 illustrate a door frame in relief representing a first embodiment of the assembly in accordance with the invention. 1 represents the external wall of a building, made of concrete or any other material. 2 shows the doorway surrounded by a frame in relief on the facade. This frame is composed of an assembly of lateral elements 3, 4, 5 and 3', 4', 5' and of three upper elements 6, 7, 7' forming a pediment. 8 and 8' are two base elements. Every element has one flat surface which is placed against the facade.

The elements 3, 4, 5, 3', 4', 5', 6, 7, 7', 8, 8' are prefabricated from a stony material such as natural or synthetic marble or alabaster, concrete, granite, sandstone or limestone. Synthetic materials may be coloured throughout if desired. These elements are mounted as "brackets" on the wall 1, as described below for the case of FIGS. 4 and 5.

Figure 4:
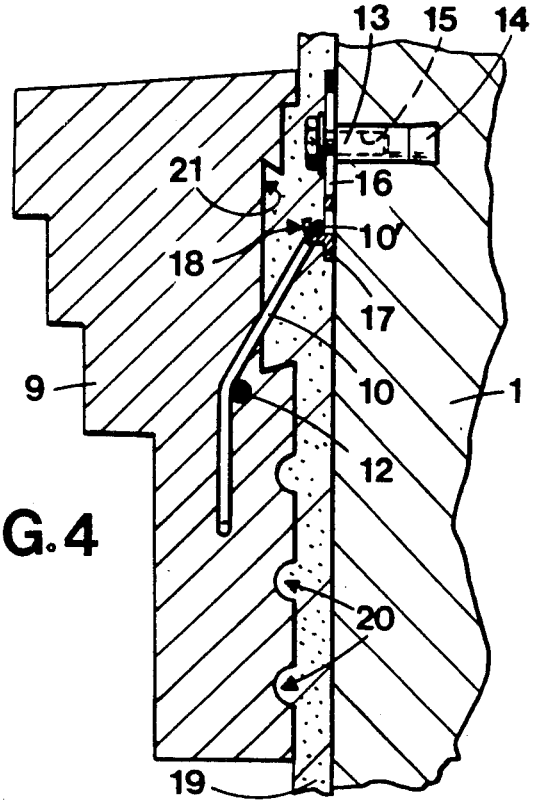
FIG. 4 is a detailed sectional view illustrating a method of mounting a decorative element such as those shown in FIGS. 1 to 3 in the form of a "bracket".

A decorative element analogous to those depicted in FIGS. 1 and 2, made for example of concrete, has a steel engaging device 10, anchored in it and presenting a visible part 10' on the surface of this element which will be placed in contact with the wall 1. As shown in FIG. 4, the engaging device 10 presses against an iron brace 12 embedded in the element 9.

One or several supporting devices such as 13 are fixed to the wall 1; each supporting device co-operates with an engaging device 10, 10'. Each supporting device 13 includes a piece 14 which is plugged into the wall 1. This piece 14 has an internal thread, and a bolt 15 forming part of the supporting device 13 is screwed into the piece 14, first passing through an oblong hole 16 in a supporting plate 17 having a gutter-shaped part 18 shaped so as to receive the part 11 of a device 10.

The decorative elements are mounted on the wall 1 as follows:

One or several pieces 14 per decorative element, depending on the weight and shape of the element, are embedded in the external surface of the wall 1. The corresponding supporting plate 17 is then placed over each piece 14 and fixed at the correct height by adjusting the position of the plate vertically and screwing the bolt 15 to full depth in order to immobilize the support at the exact height required. The element 9 is placed against the wall and the part 10' of its engaging device 10 is interlocked with the gutter 18 of the supporting plate 17. Adhesive mortar is then inserted between the element 9 and the wall. Better purchase of the element 9 mounted as a "bracket" is provided by grooves 20, 21 in the face of the element in contact with the wall 1.

The part 10' of the engaging device 10 and the gutter 18 are shaped so as to permit precise horizontal adjustment or the organ 9.

Figure 5:
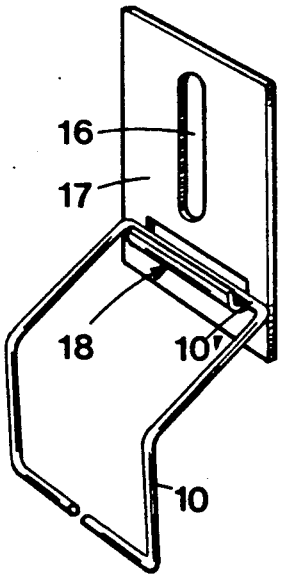
FIG. 5 is a detailed perspective view of this method of mounting.

Obviously, the decorative elements may be mounted on the facade by means of attachment other than those shown by way of example in FIGS. 4 and 5.

FIG. 3 shows differently shaped decorative elements mounted on a facade in the above-mentioned manner. Elements 22 are placed above a window 23, and other elements 24 are situated below the window. 25, 25' are two decorative elements (single or composite) placed on the left and right of the window 23 respectively, and at a certain distance from it.

The decorative elements are preferably modular. In the case of FIG. 1, the capital 6, 7, 7' may then project slightly beyond the edges of the frame 3, 4, 5 and 3', 4', 5', depending on the width of the window.

In other embodiments, the decorative elements may form cornices, balconies, banisters, columns, pilasters, etc. They may also be used in the interiors of building to frame domestic chimney-pieces, for example.

The decorative elements may be mass produced at reasonable cost. They should be dimensioned so that their weight is kept low in order to facilitate mounting. In certain cases, however, a door or window frame may be constructed from a single prefabricated element.

What is claimed is:

1. Material for decorative reliefs on walls of buildings, comprising in combination, an assortment of prefabricated decorative elements (3, 4, 5, 3', 4', 5', 6, 7, 7') made of stone, each possessing a flat surface which is placed against a surface of adhesive mortar which is inserted between each of said elements and a wall (1) of a building, each of said elements having at least one engaging device (10, 10') accessible from said flat surface, supporting devices (13) each presenting a first means (14) anchoring said device in said wall (1) of said building to abut against said wall, and second means (15, 16, 17, 18) arranged so as to be adjustable vertically and horizontally on the said first means (14) and shaped so as to co-operate with the engaging devices (10, 10') of the decorative elements, said engaging devices (10, 10') being interlocked with said supporting devices (13) previously anchored in said wall of said building so that said wall supports the weight of said decorative elements and maintains said decorative elements in position against said wall of said building, said first and second means being completely concealed between the decorative elements applied to a facade and the facade itself.

2. Material in accordance with claim 1, characterized in that it consists of groups of decorative elements which when assembled form frames for doors, windows or domestic chimney-pieces.

3. Material in accordance with claim 1, characterized in that it consists of groups of elements which when assembled form cornices, consoles, and balconies.

* * * * *